US012594645B2

(12) United States Patent
Boon et al.

(10) Patent No.: US 12,594,645 B2
(45) Date of Patent: Apr. 7, 2026

(54) METHOD AND DISK CARRIER FOR USE IN POLISHING GLASS SUBSTRATE DISKS

(71) Applicant: Western Digital Technologies, Inc., San Jose, CA (US)

(72) Inventors: Stefano Ching Kiat Boon, Sarawak (MY); Guo Sheng Hii, Sarawak (MY); Yong Lee Mok, Sarawak (MY); Tiew Cheon Ling, Sarawak (MY)

(73) Assignee: WESTERN DIGITAL TECHNOLOGIES, INC., San Jose, CA (US)

( * ) Notice: Subject to any disclaimer, the term of this patent is extended or adjusted under 35 U.S.C. 154(b) by 340 days.

(21) Appl. No.: 18/230,541

(22) Filed: Aug. 4, 2023

(65) Prior Publication Data

US 2024/0408719 A1 Dec. 12, 2024

Related U.S. Application Data

(60) Provisional application No. 63/472,092, filed on Jun. 9, 2023.

(51) Int. Cl.
*B24B 41/06* (2012.01)
*B24B 7/00* (2006.01)
(Continued)

(52) U.S. Cl.
CPC ..... *B24B 41/067* (2013.01); *B24B 7/00* (2013.01); *B24B 7/04* (2013.01); *B24B 7/24* (2013.01);
(Continued)

(58) Field of Classification Search
CPC ..... B24B 7/24; B24B 7/241; B24B 7/242; B24B 7/244; B24B 7/245; B24B 7/247;
(Continued)

(56) References Cited

U.S. PATENT DOCUMENTS

2008/0182489 A1 7/2008 Muldowney
2009/0191794 A1 7/2009 Wang

FOREIGN PATENT DOCUMENTS

CN 101362309 A * 2/2009 ..... B24B 49/16
JP H1058316 A * 3/1998
(Continued)

OTHER PUBLICATIONS

Li, Jun et al., "Design of Surface Grooves on a Polishing Pad based on Slurry Uniform Flow", The International Journal of Advanced Manufacturing Technology; Jun. 28, 2019; https://link.springer.com/article/10.1007/s00170-019-04026-0; 5 pages.

*Primary Examiner* — C. A. Rivera
(74) *Attorney, Agent, or Firm* — LOZA & LOZA, LLP; Gabriel Fitch

(57) ABSTRACT

A carrier for use in a polishing machine and a method for using the carrier during the polishing of glass substrate disks intended for use in the hard disk media of a hard disk drive. Grooves are provided in top and bottom surfaces of the carrier to, e.g., increase the flow of polishing slurry between the carrier and a pair of upper and lower polishing pads of the polishing machine during a polishing operation. Opposing grooves within the top and bottom surfaces of the carrier may be staggered or offset relative to one another. Slurry passage holes may be provided in the carrier that intersect with the grooves to allow for the passage of slurry into the grooves during polishing. Method and apparatus examples are described.

20 Claims, 8 Drawing Sheets

TOP VIEW

BOTTOM VIEW

(51) Int. Cl.

| | |
|---|---|
| ***B24B 7/04*** | (2006.01) |
| ***B24B 7/24*** | (2006.01) |
| ***B24B 37/08*** | (2012.01) |
| ***B24B 37/28*** | (2012.01) |
| ***B24B 57/02*** | (2006.01) |

(52) U.S. Cl.
CPC ..... *B24B 37/08* (2013.01); *B24B 37/28* (2013.01); *B24B 57/02* (2013.01)

(58) Field of Classification Search
CPC ..... B24B 7/248; B24B 41/0053; B24B 41/67; B24B 37/00; B24B 37/04; B24B 37/08; B24B 37/27; B24B 37/28; B24B 57/00; B24B 57/02
See application file for complete search history.

(56) References Cited

FOREIGN PATENT DOCUMENTS

| | | | |
|---|---|---|---|
| JP | 2012143845 | A | 8/2012 |
| JP | 2012216253 | A | 11/2012 |
| JP | 2015069685 | A | 4/2015 |
| JP | WO2014050241 | A1 | 8/2016 |
| JP | WO2014175292 | A1 | 2/2017 |
| KR | 20140031719 | A | 3/2014 |
| KR | 101601281 | B1 | 3/2016 |
| WO | 2006025509 | A1 | 3/2006 |

* cited by examiner

TOP VIEW

BOTTOM VIEW

PLAN VIEW

PROFILE VIEW

METHOD AND DISK CARRIER FOR USE IN POLISHING GLASS SUBSTRATE DISKS

CROSS REFERENCE TO RELATED APPLICATIONS

This application claims priority to and the benefit of U.S. Provisional Application No. 63/472,092, entitled "METHOD AND DISK CARRIER FOR USE IN POLISHING GLASS SUBSTRATE DISKS." filed Jun. 9, 2023, the entire content of which is incorporated herein by reference as if fully set forth below in its entirety and for all applicable purposes.

FIELD

The present disclosure relates, in some aspects, to glass substrate disks for use in data storage devices, and more particularly to a procedure for polishing glass substrate disks and to carriers for retaining the glass substrate disks during the polishing procedure.

INTRODUCTION

Hard disk drives (HDD) are magnetic data storage devices used for storing and retrieving digital information using rapidly rotating disks. Each disk includes a glass substrate that is polished before various magnetic recording layers are deposited thereon. During polishing within a polishing machine, a set of the glass substrate disks may be held within a carrier between a pair of opposing polishing pads. Issues can arise during polishing, such a slow and/or inconsistent rate of removal of portions of the substrate being polished off. Herein, these and other issues are addressed by providing improved procedures for polishing glass substrate disks and improved carriers for retaining the glass substrate disks during polishing.

SUMMARY

The following presents a simplified summary of some aspects of the disclosure to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present various concepts of some aspects of the disclosure in a simplified form as a prelude to the more detailed description that is presented later.

In one embodiment, a carrier is provided for retaining glass substrates during polishing. The carrier includes: a planar carrier body comprising a plurality of circular openings, each configured to receive a disk shaped glass substrate; wherein the carrier body comprises first grooves on a top surface of the carrier body; wherein the carrier body comprises second grooves on a bottom surface of the carrier body; wherein the carrier body is configured to be rotated relative to an adjacent polishing pad to polish a glass substrate; and wherein the first and second grooves are configured to facilitate a flow of a polishing slurry between the carrier body and the polishing pad during the polishing.

In another embodiment, another carrier is provided for retaining glass substrates during polishing. The carrier includes: a planar carrier body comprising a plurality of circular openings, each configured to receive a disk-shaped glass substrate; wherein the carrier body further comprises a slurry passage hole configured to facilitate passage of a polishing slurry from one side of the carrier body to the other side of the carrier body; wherein the carrier body comprises first grooves on a surface of the carrier body; wherein the carrier body is configured to be rotated relative to an adjacent polishing pad so that the glass substrates are polished; and wherein the first grooves are configured to facilitate a flow of the polishing slurry between the carrier body and the polishing pad during the polishing.

In yet another embodiment, a method is provided for polishing glass substrates using a carrier for retaining the glass substrates during polishing, the method includes: providing the carrier comprising: a planar carrier body comprising a plurality of circular openings, each configured to receive a disk-shaped glass substrate; wherein the carrier body comprises first grooves on a top surface of the carrier body; wherein the carrier body comprises second grooves on a bottom surface of the carrier body; placing the carrier on a first polishing pad of a polishing machine; placing glass substrates within the circular openings of the carrier; placing a second polishing pad on the carrier; providing a polishing slurry on the carrier, wherein the first and second grooves facilitate a spreading of the polishing slurry; and rotating the carrier between the first and second polishing pads to polish the glass substrates.

DETAILED DESCRIPTION

Figure 1A:
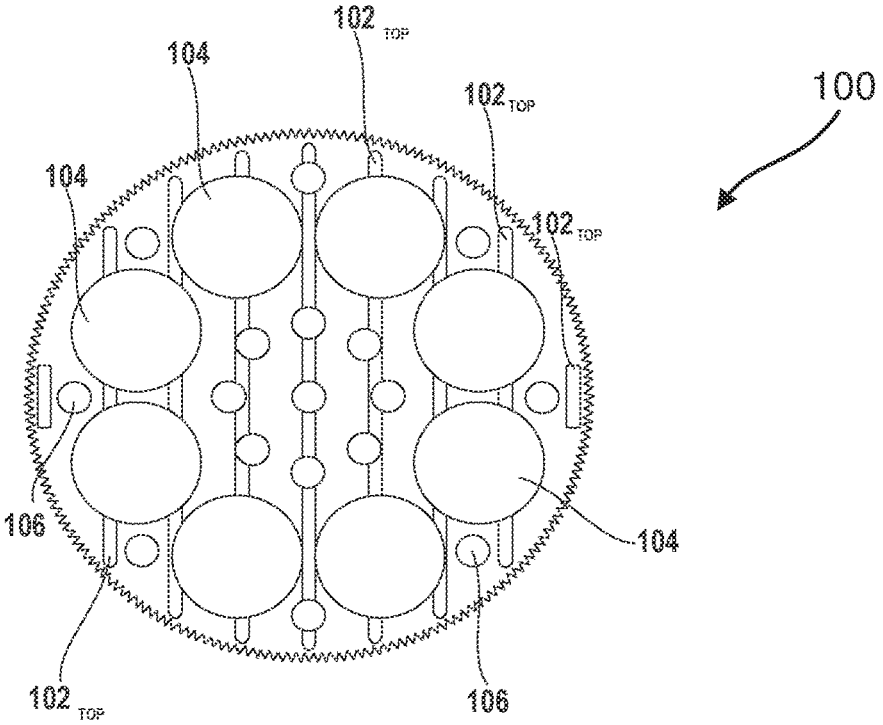
FIG. 1A illustrates a top view of a glass substrate carrier having pockets for holding glass substrate disks to be polished, with the carrier also including grooves and slurry passage holes, configured in accordance with an aspect of the disclosure.

In the following description, specific details are given to provide a thorough understanding of the various aspects of the disclosure. However, it will be understood by one of ordinary skill in the art that the aspects may be practiced without these specific details. For example, circuits may be shown in block diagrams in order to avoid obscuring the aspects in unnecessary detail. In other instances, well-known circuits, structures and techniques may not be shown in detail in order not to obscure the aspects of the disclosure.

As noted above, issues can arise during polishing of the glass substrate of a hard disk for using in a hard disk drive, such as a slow and/or inconsistent rate of removal of portions of the glass substrate disk during polishing while the glass substrate disk is held within a carrier (or disk holder) that is positioned between a pair of opposing polishing pads of a polishing machine. Removal problems might be addressed, in some cases, by increasing the polishing time. However, this can lead to (a) a reduction in the parts per hour (PPH) that can be polished, (b) a reduction in the carrier life, (c) a reduction in the polishing pad life, (d) an increase the consumption of slurries used during polishing, and can also (e) negatively affect key quality control (KQC) factors such as achieving a sufficient amount of polishing. Any or all of these issues can increase the overall production cost.

Typically, polishing is a two-step process performed by one or more polishing machines. During the first step, a set of glass substate disks to be polished are placed within a thin carrier and then the polishing machine operates to rub a pair or polishing pads against the top and bottoms surfaces of disks while a slurry of cerium oxide ($CeO_2$) particles are applied to the disks to perform a rough polish. During the second step, the disks are again held within a carrier while the polishing machine operates to rub a pair of polishing pads (which may be different pair of pads than the ones used in the first step) against the disks, this time along with a slurry of silica particles to perform the fine polish. The inconsistent removal rate discussed above can be addressed during the first step of the polishing procedure by providing grooves within the polishing pads. The grooves in the pad enable more slurry to flow across the pad to improve the consistency (e.g., uniformity) of the removal rate. However, as a practical matter, grooves cannot be employed within the pads during the second step of the polishing procedure because the presence of grooves on the pads would create stain patterns or other uneven wear patterns on the substrate surface. (Such stains or uneven wear patterns are not a problem following the first rough polishing stage since they can be removed during the subsequent fine polishing stage, but stains occurring during the fine polishing would remain in the substrate.)

Herein, a carrier and a method for using the carrier during polishing are described wherein grooves are provided on the carrier used during the fine polishing stage. The grooves may also be referred to as sunken grooves or troughs. One purpose for the grooves in the carrier is to increase the slurry flow between the carrier and the polishing pads during the fine polishing stage. For example, silica slurry can flow more evenly onto and under the carrier through the grooves. Since the carrier is thin, the grooves on the top and bottom surfaces of the carrier can be staggered or offset relative to one another to avoid reducing the overall strength and durability of the carrier. The grooves may be formed in the carrier by slowly milling through the carrier surface while the carrier is clamped onto a miller stage. Any burrs from milling may be removed using, e.g., a penknife. Sandpaper may be used to smooth the edges of the grooves.

In one exemplary embodiment, a carrier for retaining glass substrates during polishing is provided wherein the carrier includes a planar carrier body including a plurality of circular openings or pockets, each configured to receive a disk-shaped glass substrate. The carrier body includes first grooves on a top surface of the carrier body and second grooves on a bottom surface of the carrier body. The carrier body is configured to be rotated relative to an adjacent polishing pad or pads to polish a glass substrate. The first and second grooves are configured to facilitate a flow of a polishing slurry between the carrier body and the polishing pad during the polishing and, further, to help retain at least some of the slurry near the substrates during a polishing operation, rather than to feed slurry away from the substrates being polished.

In another exemplary embodiment, a polishing machine is provided that includes: a central rotating mechanism configured to rotate a grooved carrier as described above; a first polishing pad in contact with the bottom surface of the carrier; and a second polishing pad in contact with the top surface of the carrier.

In yet another exemplary embodiment, a carrier is provided for retaining glass substrates during polishing. The carrier includes a planar carrier body comprising a plurality of circular openings, each configured to receive a disk-shaped glass substrate. The carrier body further includes a slurry passage hole configured to facilitate passage of a polishing slurry from one side of the carrier body to the other side of the carrier body. The carrier body also includes first grooves on a surface of the carrier body. The carrier body is configured to be rotated relative to an adjacent polishing pad to polish glass substrates held within the carrier. The first grooves are configured to facilitate a flow of the polishing slurry between the carrier body and the polishing pad during the polishing.

In still yet another exemplary embodiment, a method is provided for polishing glass substrates using a carrier for retaining the glass substrates during polishing. The method includes: providing the carrier that includes a planar carrier body with a plurality of circular openings, each configured to receive a disk-shaped glass substrate; wherein the carrier body includes first grooves on a top surface of the carrier body and second grooves on a bottom surface of the carrier body. The method also includes: placing the carrier on a first polishing pad of a polishing machine; placing glass substrates within the circular openings of the carrier; placing a second polishing pad on the carrier; providing a polishing slurry on the carrier, wherein the first and second grooves facilitate spreading of the polishing slurry; and rotating the carrier between the first and second polishing pads to polish the glass substrates.

Figure 1B:
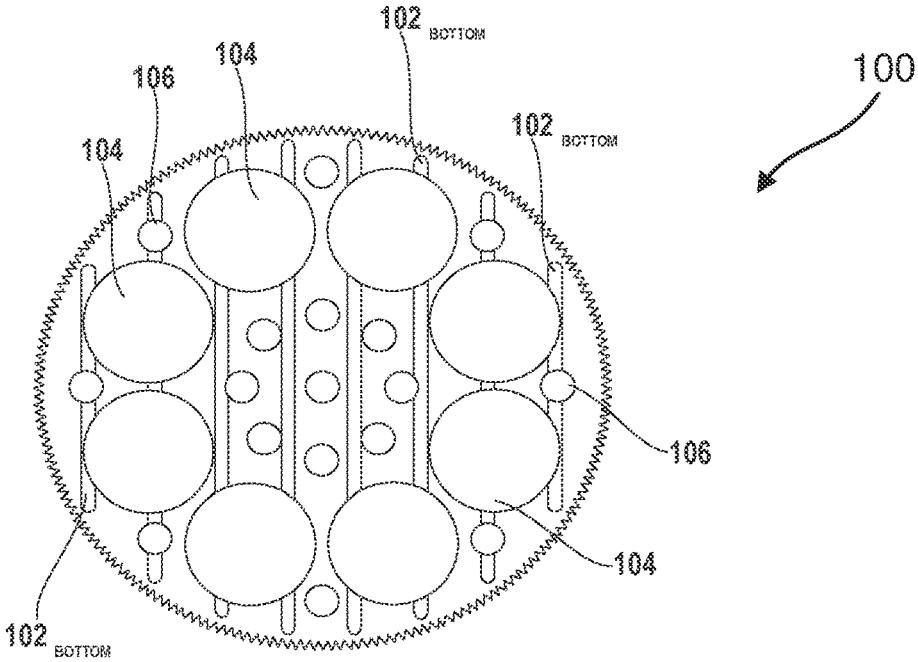
FIG. 1B illustrates a bottom view of the glass substrate carrier of FIG. 1A, configured in accordance with an aspect of the disclosure.

FIGS. 1A-B illustrate top and bottom views, respectively, of a carrier 100 having a set of top surface grooves $\mathbf{102}_{top}$, a set of bottom surface grooves $\mathbf{102}_{bottom}$, and a set of circular openings or pockets 104 for receiving and holding the disk-shaped substrates (not shown) to be polished. Note that the grooves are depressions (or troughs or trenches or valleys) formed in the carrier that do not extend completely through the carrier. Each may extend, for example, about one quarter of the way through the thin carrier material. The grooves serve to increase slurry flow between the carrier and an adjacent groove-less polishing pad (not shown), while enabling the slurry to flow evenly onto and under the carrier through the grooves.

The grooves $\mathbf{102}_{top}$ formed in the top surface of the carrier 100 are parallel to one another. The grooves $\mathbf{102}_{bottom}$ formed on the bottom surface of the carrier 100 are parallel to one another and also parallel to the top surface grooves. The top surface grooves $\mathbf{102}_{top}$, and the bottom surface grooves $\mathbf{102}_{bottom}$ are offset (or staggered) relative to one another as shown so that none of the bottom surface grooves $\mathbf{102}_{bottom}$ are formed directly under any of the top surface grooves $\mathbf{102}_{top}$, which might otherwise weaken the thin carrier 100. That is, no top surface grooves $\mathbf{102}_{top}$, are directly opposite any of the bottom surface grooves $\mathbf{102}_{bottom}$. Rather, each bottom surface groove $\mathbf{102}_{bottom}$ is formed between a pair of the top surface grooves $\mathbf{102}_{top}$.

Some of the grooves are relatively short, whereas others are relatively long and extend across the carrier from near one outer edge to another outer edge through the center of the carrier. Note that the ends of the grooves should not be too close to the edges of the carrier, otherwise the carrier edges could become too weak. Accordingly, the grooves are preferably no closer than 5 mm to the edge of the carrier 100. The carrier edges, as shown, have teeth, which engage with gear mechanisms in a polishing machine that cause the carriers to spin during polishing. (See, FIGS. 6A-B, described below.) In the example of FIGS. 1A and 1B, there are nine top surface grooves and eight bottom surface grooves. In other embodiments, there may be more or fewer grooves and the relative lengths and widths may differ from what is shown in the figures. The carrier may be formed, e.g., of aramid (aromatic polyamide).

The pockets 104 extend completely through the carrier 100 and hence appear in both FIGS. 1A-B. Each pocket is sized to hold one disk-shaped substrate to be polished. In the example of FIGS. 1A-B, the carrier 100 has eight pockets 104, thus enabling eight substrates to be held within the carrier 100 during a polishing operation. A polishing machine may hold, for example, five carriers, thus enabling a total of forty substrates to be polished at the same time. In other examples, more or fewer pockets may be provided within each carrier and/or more or fewer carriers may be held within the polishing machine at the same time.

Also shown in FIGS. 1A-B is a set of slurry passage holes 106, which extend completely through the carrier 100 and hence appear in both FIGS. 1A-B. Most or all of the slurry passage holes 106 are formed along (or at least intersecting with) one of the grooves, either a top surface groove $\mathbf{102}_{top}$ or a bottom surface groove $\mathbf{102}_{bottom}$, to enable slurry to pass between the holes and the grooves during polishing. At least some of the grooves also intersect with one or more pockets 104 to enable slurry to pass between the pockets and the grooves during polishing. In the example of FIGS. 1A-B, seventeen total slurry passage holes 106 are shown with each of the holes 106 being about twice as wide in diameter as compared to the lateral width of the grooves. In other examples, more or fewer slurry passage holes 106 may be provided and their diameters may be larger or smaller than what is shown in FIGS. 1A-B. Note also that, in FIGS. 1A-B, only some of the many grooves, pockets and holes are specifically identified by the reference numerals so as not to unduly clutter the image.

Figure 2:
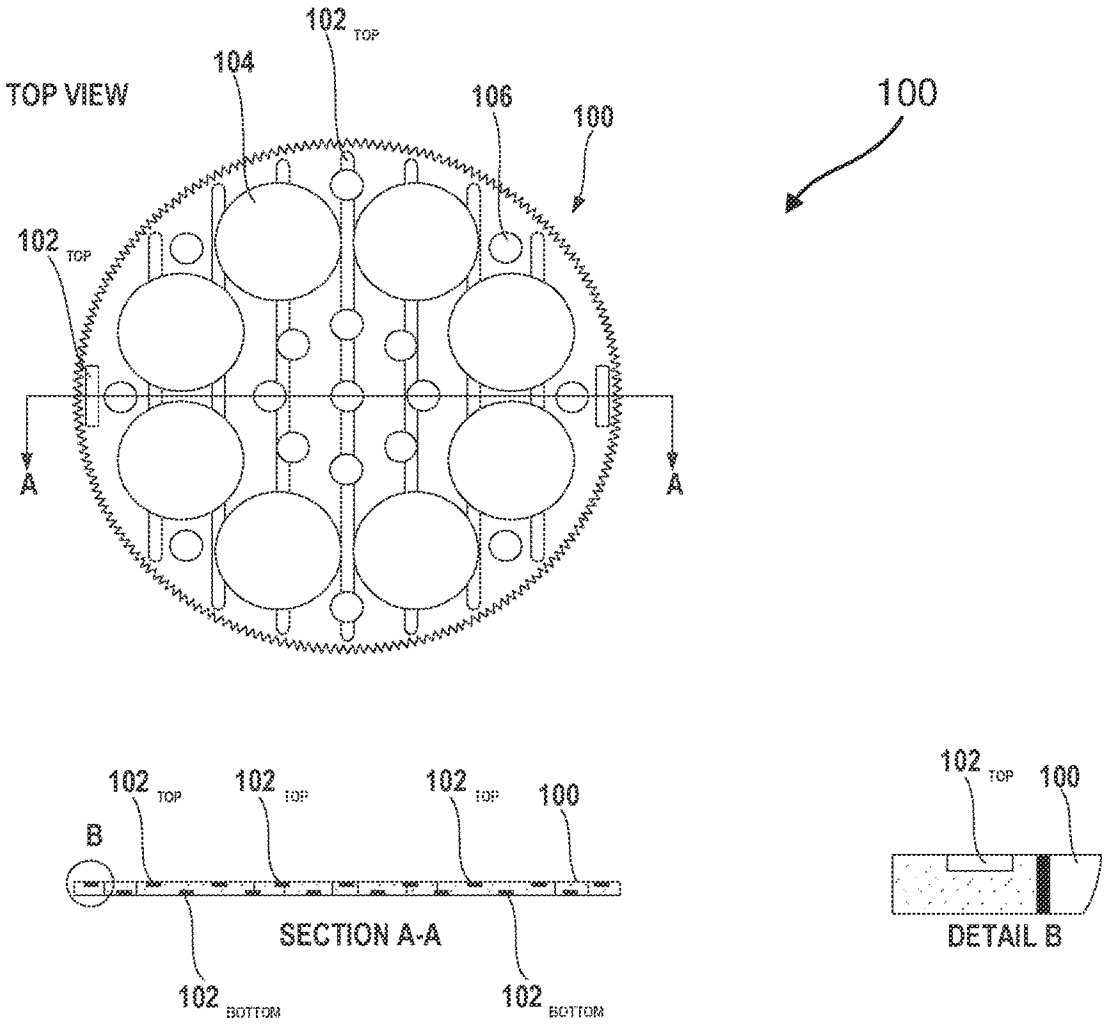
FIG. 2 illustrates another top view of the glass substrate carrier of FIG. 1A, along with a cross-sectional view of the carrier and a detailed view of an end portion of the cross-section, with the carrier configured in accordance with an aspect of the disclosure.

FIG. 2 provides a view of the top surface of the carrier 100 along with an A-A sectional view through the carrier 100, showing both the top surface grooves $\mathbf{102}_{top}$ and the bottom surface grooves $\mathbf{102}_{bottom}$ in cross-section. As show, the top and bottom grooves are offset from one another laterally along the carrier. i.e. staggered relative to one another. That is, top surface grooves are offset from the bottom surface grooves along a plane that is substantially parallel to the planar carrier body. As noted above, this is so that bottom surface grooves are not formed directly under top surface grooves, which might weaken the carrier 100 at that location.

A Detail B of the cross-section A-A of FIG. 2 illustrates the depth of one of the top surface grooves $\mathbf{102}_{top}$, which, as shown, extends about one quarter of the distance through the carrier. In other examples, the depth may be greater or less. Note that the shallower the groove, the less slurry it can hold. The deeper the groove, the weaker the carrier might become at that location. Generally speaking, the grooves are sized, positioned, and configured to facilitate a flow of a polishing slurry between the carrier body 100 and the polishing pads (not shown n FIG. 2) during polishing while retaining at least some slurry near the substrates during a polishing operation, rather than feeding slurry away from the carrier and away from the substrates being polished.

In one particular example: the diameter of the carrier 100 is 427 mm; the thickness of the carrier 100 is 0.4 mm; the diameter of each pocket 104 is 98 mm; the diameter of each slurry passage hole 106 is 25 mm; the width of each groove 102 is 10 mm; the length of the longest of the grooves 102 is 400 mm; the length of the shortest of the grooves 102 is 40 mm; the depth of each groove into the carrier is 0.1 mm; and the thickness of the disk before fine polishing is about 0.5 mm.

Figure 3:
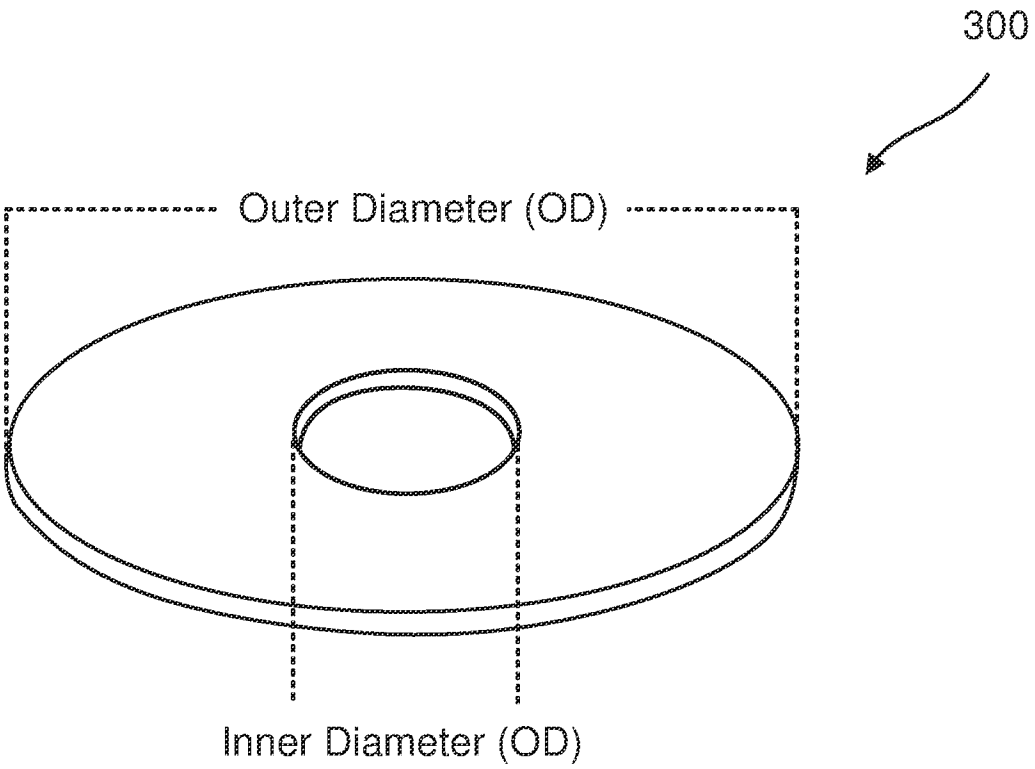
FIG. 3 illustrates a perspective view of a glass substrate for insertion into a grooved carrier configured in accordance with an aspect of the disclosure.

FIG. 3 illustrates a perspective view of a disk-shaped glass substrate 300 to be polished. The substrate 300 has an outer diameter (OD) and an inner diameter (ID). The pockets 104 of the carrier 100 shown in FIGS. 1A-B and 2 are sized to securely hold the disk-shaped glass substrate 300. That is, the diameter of a pocket 104 of the carrier 100 of FIGS. 1A-B and 2 is about the same size (or just slightly larger) than the OD of the glass substrate 300.

Figure 4:
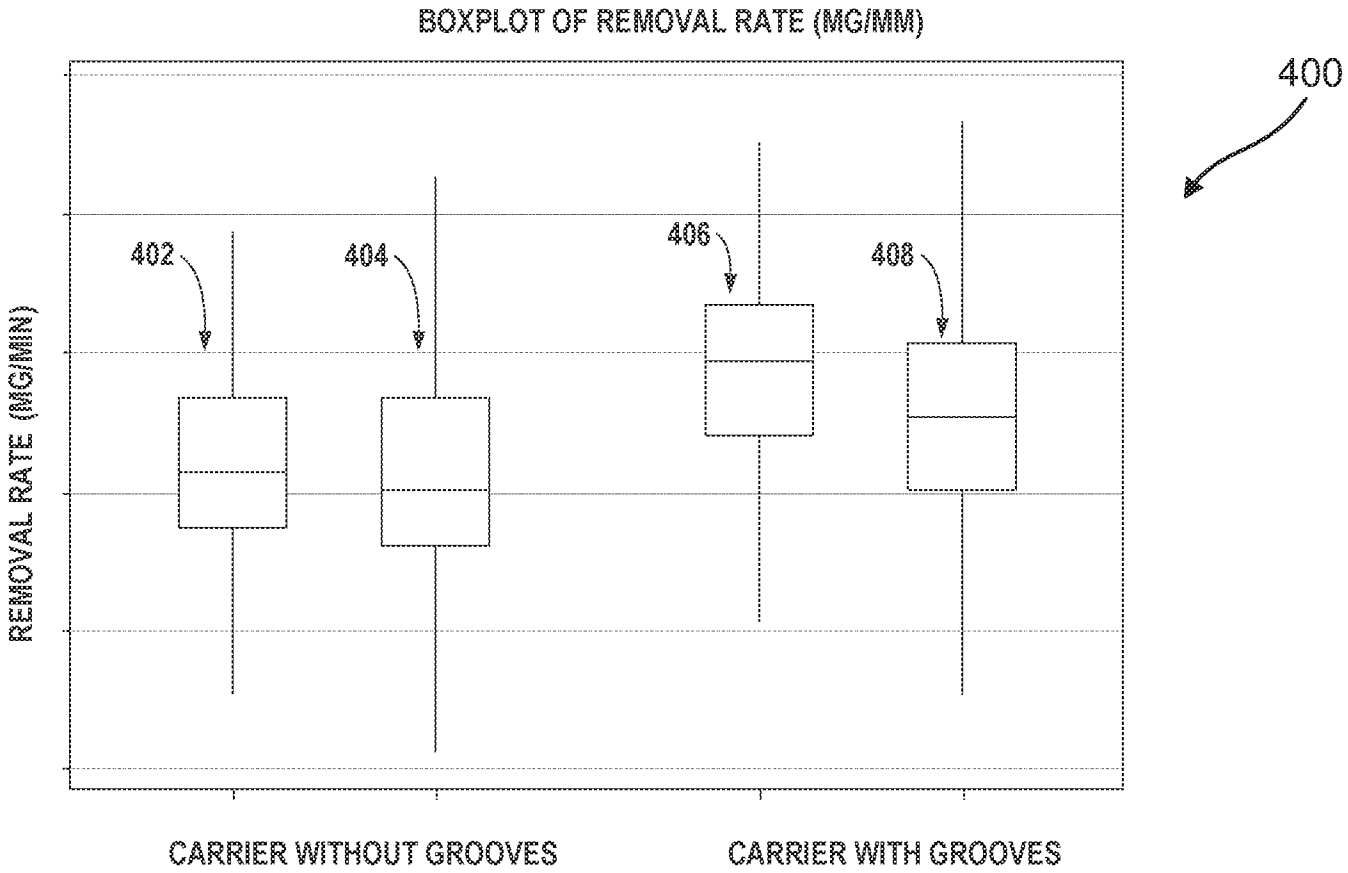
FIG. 4 illustrates a graph of removal rates achieved using grooved carriers as compared to non-grooved carriers, in accordance with aspects of the disclosure.

FIG. 4 illustrates a boxplot graph 400 of the removal rate in milligrams per minute (mg/min) achieved during fine polishing of a glass substrate when using a carrier without grooves (e.g., a carrier similar to carrier 100 of FIGS. 1A-B but without grooves) as compared to a carrier with grooves (e.g., the carrier 100 of FIGS. 1A-B). Four examples are shown: example 402 is representative of data collected while using a non-grooved carrier in the first of two test polishing machines; example 404 is representative of data collected while using a non-grooved carrier in the second of the two test polishing machines; example 406 is representative of collected while using a grooved carrier in the first of the two test polishing machines; example 408 is representative of while using the grooved carrier in the second of the two test polishing machines. The boxplots illustrate median, min, max, first quartile, and third quartile values per standard boxplot notation.

FIG. 4 illustrates that the removal rates when using the carrier with grooves are generally better than the removal rates when using the carrier without grooves. Note that FIG. 4 does not show absolute numerical values for the removal rates since the removal rates can vary from polishing machine to polishing machine and on other factors and the purpose of the figure is merely to illustrate a relative increase achieved when using grooved carriers as compared to non-grooved carriers. In the illustrative example, the median removal rate was found to increase by about 20% or more when using a grooved carrier as opposed to a groove-less carrier. The higher removal rate allows for shorter polishing times, which can increase PPH and reduce the consumption of slurries and thus reduce overall production costs. Note that over-polishing is not often a problem and so there is little or no concern that the faster polishing rates achieved using the grooved carrier might result in over-polishing of the substrates. Still further, note that although the carriers and polishing procedures described herein are primarily intended for use in polishing glass substrates for use in hard disk drive media, at least some of the features or procedures described herein are applicable to other substrate materials including, in some examples, aluminum alloys or ceramics, or substrates for other applications.

Figure 5:
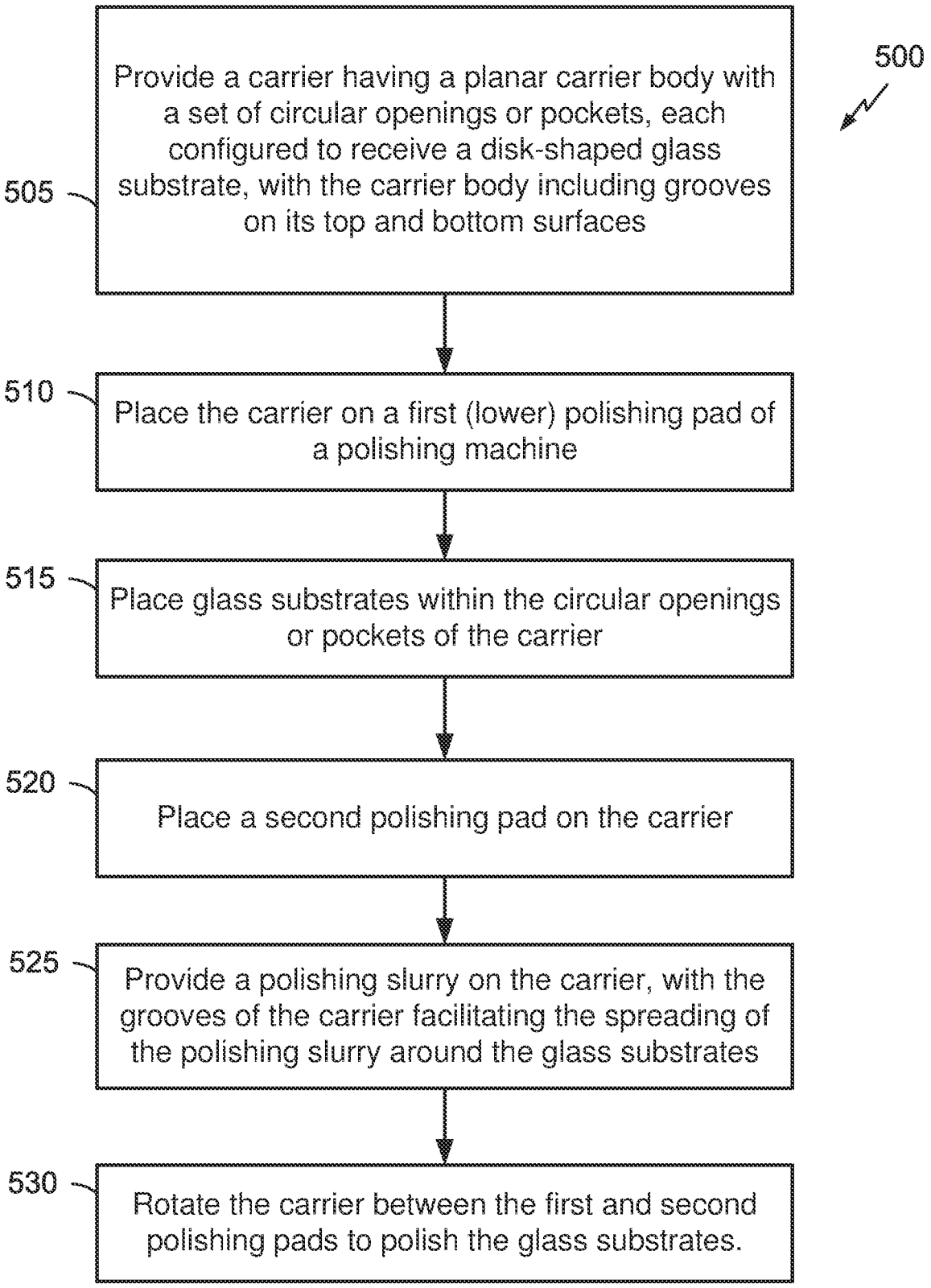
FIG. 5 illustrates an exemplary flow diagram of a method for polishing a glass substrate disk using a grooved carrier, in accordance with an aspect of the disclosure.

FIG. 5 illustrates an exemplary flow diagram of a method 500 for a polishing procedure for polishing a glass substrate where the procedure employs a grooved carrier, such as the grooved carrier described above in connection with FIGS. 1A-B and 2. It should be noted that the sequence of FIG. 5 may combine one or more processes to simplify and/or clarify the method for polishing the glass substrate. In some implementations, the order of the processes may be changed or modified. The glass substrate may be subjected to an initial rough polishing procedure (not shown in FIG. 5) with the procedure of FIG. 5 then providing a fine polishing procedure. The thickness of the initial (unpolished) glass substrate may be equal to or less than 4 mm, equal to or less than about 3 mm, equal to or less than about 2 mm, equal to or less than about 1.5 mm, equal to or less than about 1 mm, equal to or less than about 0.7 mm, equal to or less than about 0.5 mm, or equal to or less than about 0.3 mm. For example, in some embodiments, the thickness may be equal to or less than about 0.1 mm, such as in a range from about 0.05 mm to about 0.1 mm. Note though that the thinner the substrate, the thinner the carrier. Very thin carriers do not accommodate much depth for the grooves and so grooves can be more effective within thicker carriers for use with thicker substrates. In some examples, the substrates to be polished each has an outer diameter (i.e., OD) of about 97 mm. In other examples, the OD may be 95 mm or 95.1 mm. (Generally speaking, such disks are all referred to as "3.5 inch" disks.)

At block 505, a carrier, which may be formed of aramid, is provided where the carrier has a planar carrier body with a set of circular openings, each configured to receive a disk-shaped glass substrate, with the carrier body including grooves on its top and bottom surfaces. The carrier may be about the same thickness as the substrates to be polished, e.g., having one of the thickness values as listed above. The diameters of the circular openings may be about the same as the outer diameters of the substrates, e.g., 97 mm.

At block 510, the carrier is placed on a first (lower) polishing pad of a polishing machine. Depending upon the polishing machine, the carrier may be manually positioned onto the pad or an automated system may be used to place the carrier (e.g., a robotic system).

At block 515, the disk-shaped glass substrates to be polished are placed within the circular openings or pockets of the carrier. When using the carrier of FIGS. 1A-B, eight substrates are placed in the carrier, with each substrate in a different one of the eight pockets of the carrier. With the substrates placed within the pockets of the carrier, the lower or bottom surfaces of the substrates may rest against or abut portions of the first (lower) polishing pad.

At block 520, a second (upper) polishing pad is placed on the carrier. With the second (upper) polishing pad placed on the carrier, portions of the second (upper) polishing pad may rest against or abut the substrates within the pockets of the carrier. Depending upon the polishing machine, the second (upper) polishing pad may be manually positioned onto the carrier or an automated system may be used to place the pad (e.g., a robotic system).

At block 525, a polishing slurry is provided on the carrier (e.g., the slurry is poured onto the carrier), with the grooves of the carrier facilitating the spreading of the polishing slurry around the top and bottom surfaces of the glass substrates that are held within the pockets of the carrier. The slurry may be, e.g., a slurry of silica particles.

At block 530, the carrier is rotated (typically at high speed) by the polishing machine between the first and second polishing pads to thereby polish the top and bottom surfaces of the glass substrate(s).

As noted, there can be an initial or first stage rough polishing procedure. The first stage rough polishing procedure may be generally the same as the second stage fine polishing procedure of FIG. 5 but with grooves provided in the polishing pads that are used during the first stage rather than in the carrier (and with a different slurry used during rough polishing, as discussed above). In still other examples, grooves may be provided in the carriers used during both rough polishing and later during fine polishing.

Figure 6A:
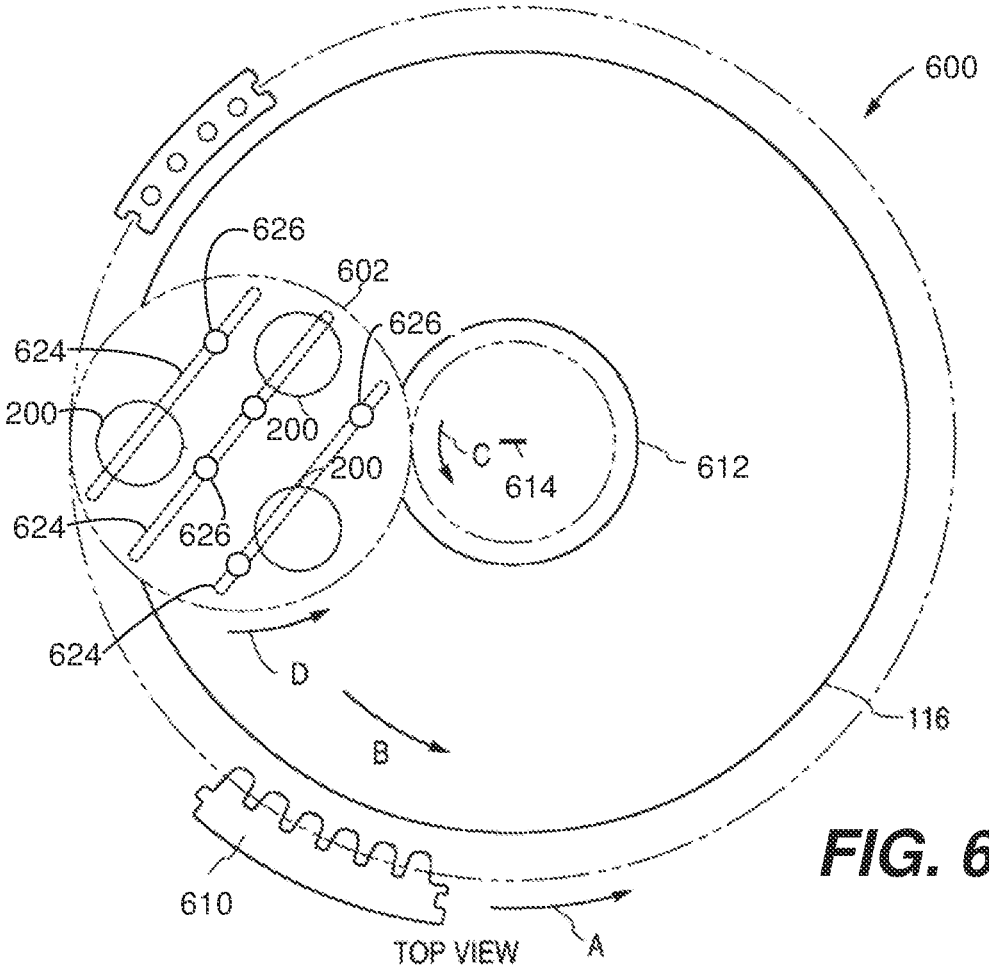
FIGS. 6A-B illustrate a top view and a side cross-sectional view of an embodiment of a polishing apparatus or machine configured to polish a set of glass substrates, wherein the apparatus includes grooved carriers in accordance with one aspect of the disclosure.
Figure 6B:
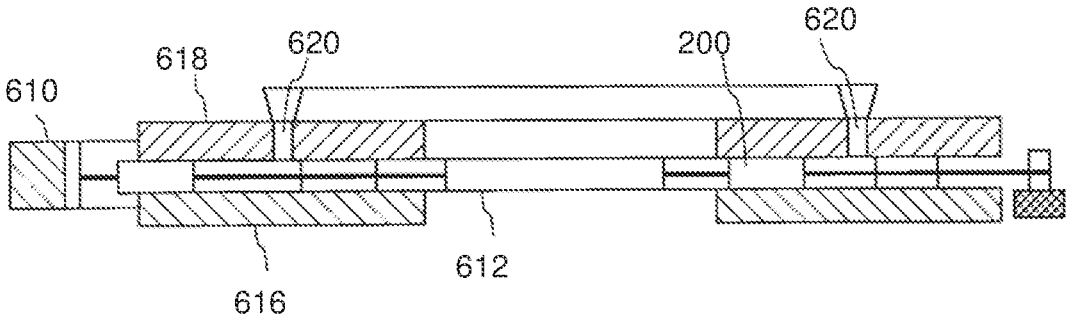

FIGS. 6A-B illustrate an example of a polishing apparatus or polishing machine 600. The exemplary polishing apparatus 600 includes a circular grooved carrier (or disk holder or disk retainer) 602 that holds a set of disk-shaped glass substrates 200 during polishing. Three disk-shaped glass substrates 200 are held by the exemplary grooved circular carrier 602 in FIGS. 6A-B. However, the polishing apparatus 600 may be configured to simultaneously or concurrently polish more or fewer of the disk-shaped glass substrates 200. For example, the grooved carrier 100 of FIGS. 1A-B may be used that holds eight disks. Also, additional carriers may be provided that are spaced around central member 612, with each carrier holding a set of disk-shaped glass substrates. In some examples, five carriers are used with each carrier holding eight disk-shaped substrates so that forty substrates can be polished at the same time. Within FIG. 6A, three exemplary top surface grooves 624 are illustrated within carrier 602 along with various slurry passage holes 626 that intersect with the grooves. More or fewer grooves and/or more or fewer holes may be provided as described above, including both top surface grooves and bottom surface grooves. In particular, the carrier 602 may be configured as shown in FIGS. 1A-B with a set of top surface grooves and a set of bottom surface grooves that are parallel with one another but staggered or offset from one another.

During polishing, a gear drive 610 rotates in the direction of arrow A around the central circular member 612, causing carrier 602 to move around the circular member 612 in a direction B. Concurrently, the central circular member 612 rotates in a direction C, about its center 614, and carrier 602 rotates around its central axis in direction a D. Both the central member 612 and the gear drive 610 have teeth that engage with teeth on the perimeter of the carrier 602 to effectuate the movement and rotation of the carrier 602. A top surface of the first or lower polishing pad 616 and a top surface of a second or upper polishing pad 618 rub against the glass substrates 200 while the carrier 602 is in motion. A polishing liquid or slurry, not shown, is poured onto the carrier 602, e.g., a silica slurry. The slurry is applied to the regions between the pads 616, 618 of FIG. 6B and the glass substrates 200 via the channels 620 of FIG. 6B and the slurry is spread and conducted via the grooves 624 and the passage holes 626. As the carrier 602 is rotated or spun within the polishing apparatus 600, the slurry helps polish the top and bottom surfaces of the substrate disks 200 that are held within the disk-shaped pockets of the carrier 602. Note that the grooves 624 and holes 626 are not shown in FIG. 6B.

The polishing machine can be any of a variety of known polishing machines used in the art that are configured for polishing substrates wherein one or more carriers are used to hold one or more substrates against one or more pads while either the carrier(s) or the pad(s) are moved so the pad(s) rub against the substrates and where a slurry may be used.

Figure 7:
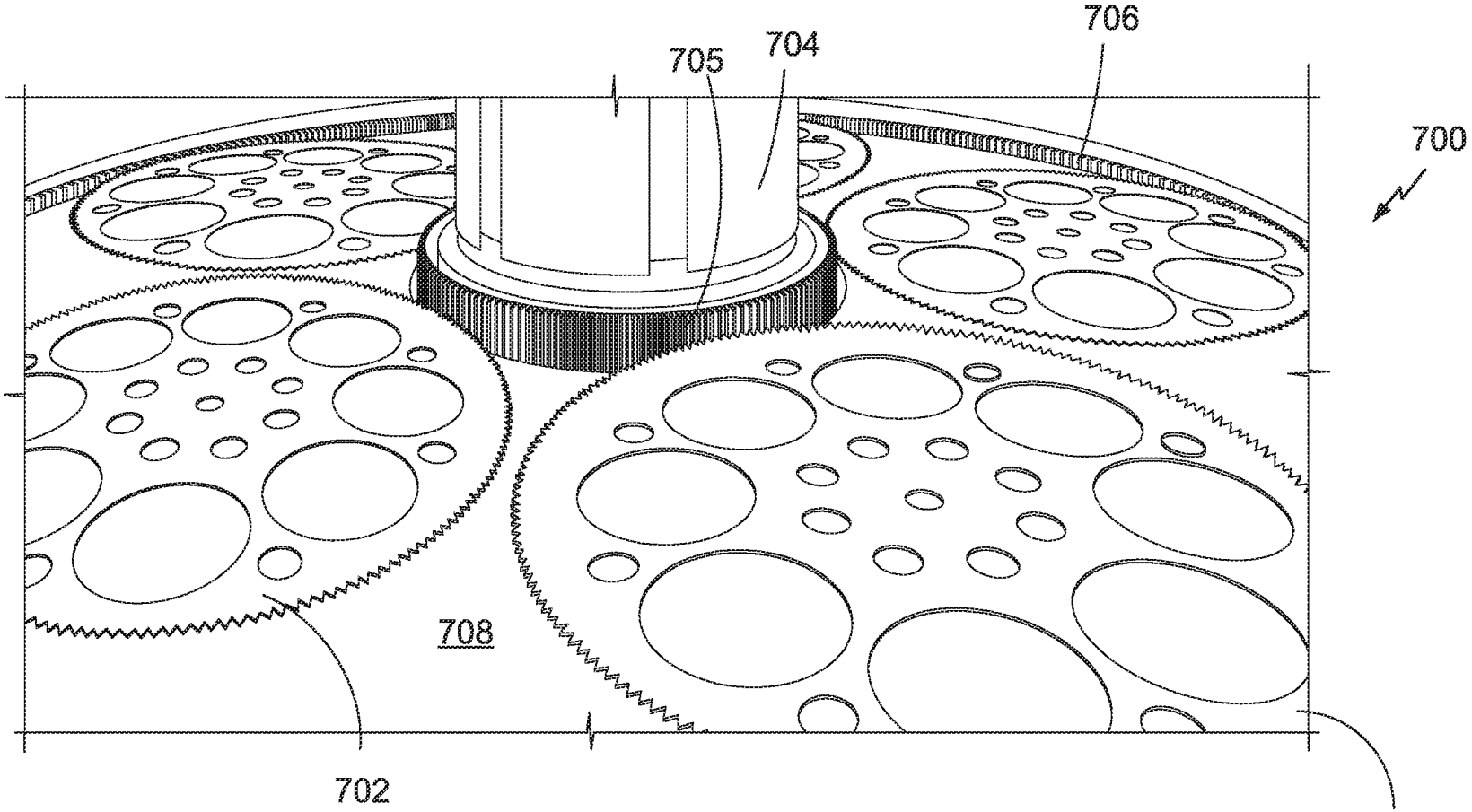
FIG. 7 is a perspective view of a polishing machine that accommodates five carriers, each with eight pockets for retaining eight substrates for polishing, in accordance with one aspect of the disclosure.

FIG. 7 is a perspective view of a portion of a polishing machine 700 that accommodates, in this example, five carriers 702, each with eight pockets for retaining eight substrates (not shown) for polishing. Each of the carriers may be provided with grooves—not shown in FIG. 7—such as the top and bottom grooves of FIGS. 1A-B. A set of inner teeth 705 on the perimeter of a central hub or central member 704 engage with teeth on the perimeter of the carriers 702 to cause the carriers to spin during polishing. A set of outer teeth 706 encircle the set of carriers and also engage with the teeth of the carriers. In use, the carriers 702 are laid flat against a lower polishing pad 708, which covers the area encircled by the outer set of teeth 706. An upper polishing pad (not shown) may be placed on top of the carriers 702, as already explained. (Note that in the view of FIG. 7, some of the carriers are not shown flat against the pad 708 as they would be during an actual polishing operation.)

Figure 8:
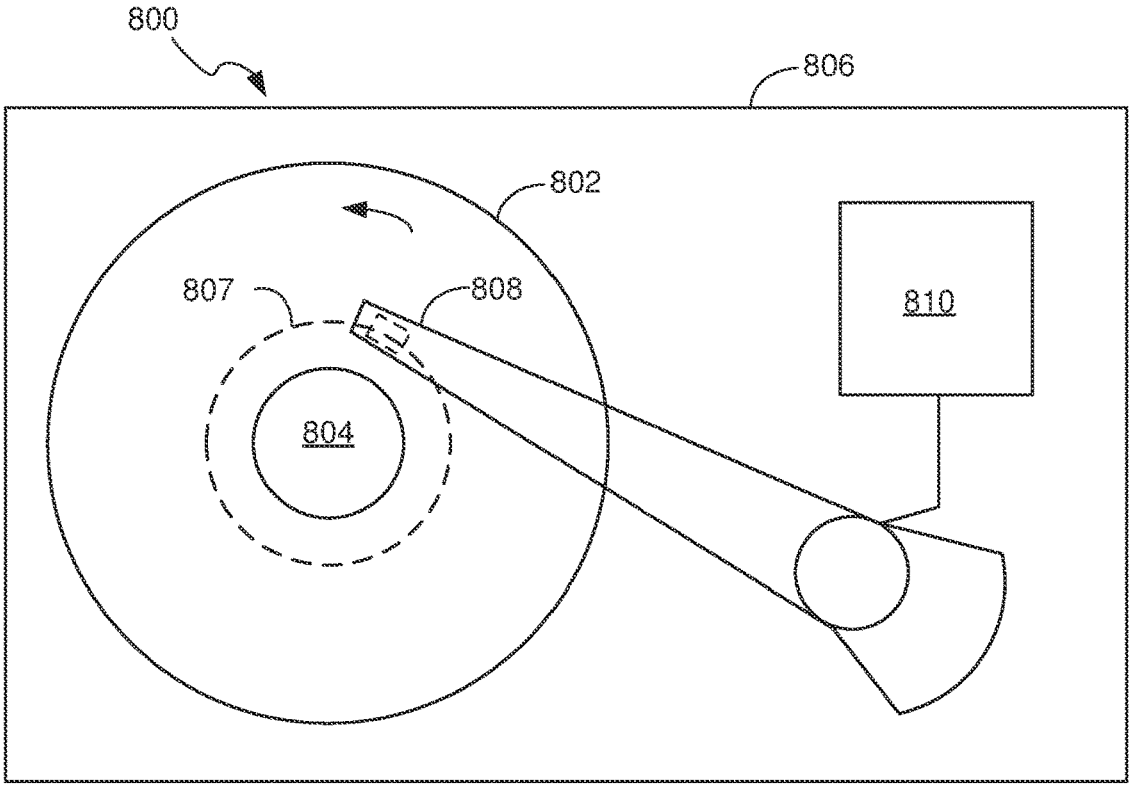
FIG. 8 illustrates a top plan view of a disk drive in accordance with one aspect of the disclosure.

FIG. 8 illustrates a plan view of a disk drive 800 (e.g., hard disk drive) configured for using disks with glass substrates. The disk drive 800 may be a type of a magnetic storage device. The disk drive 800 includes one or more magnetic media 802 (e.g., disk), a spindle assembly 804, a drive housing 806, a slider 808 and a position control circuitry 810. The slider 808 may include a slider head. The position control circuitry 810 may be used to position the slider head over a preselected track (e.g., track 807) on the media 802. The one or more media 802 may be configured to store data. The media 802 may be a magnetic recording medium. The media 802 may be a media disk. The media 802 may be a means for storing data.

As described herein, the media 802 may include glass substrates having substrates polished as described herein. The media 802 is positioned on the spindle assembly 804 that is mounted to the drive housing 806. Data may be stored along tracks (e.g., track 807) in the magnetic recording layer of the media 802. The reading and writing of data are accomplished with a read element and a write element located within the slider 808. The write element is used to alter the properties of the magnetic recording layer of the media 802 and thereby write information thereto. In an implementation, the slider 808 may include an inductive read/write head or a Hall effect head.

During an operation of the disk drive 800, a spindle motor (not shown) rotates the spindle assembly 804, and thereby rotates the media 802. The slider 808 may be positioned over the media 802 at a particular location along a preselected disk track 807. The positions of the slider 808, relative to the media 802 may be controlled by a position control circuitry 810. As the media 802 is rotating, the slider 808 may glide over the media 802.

Figure 9:
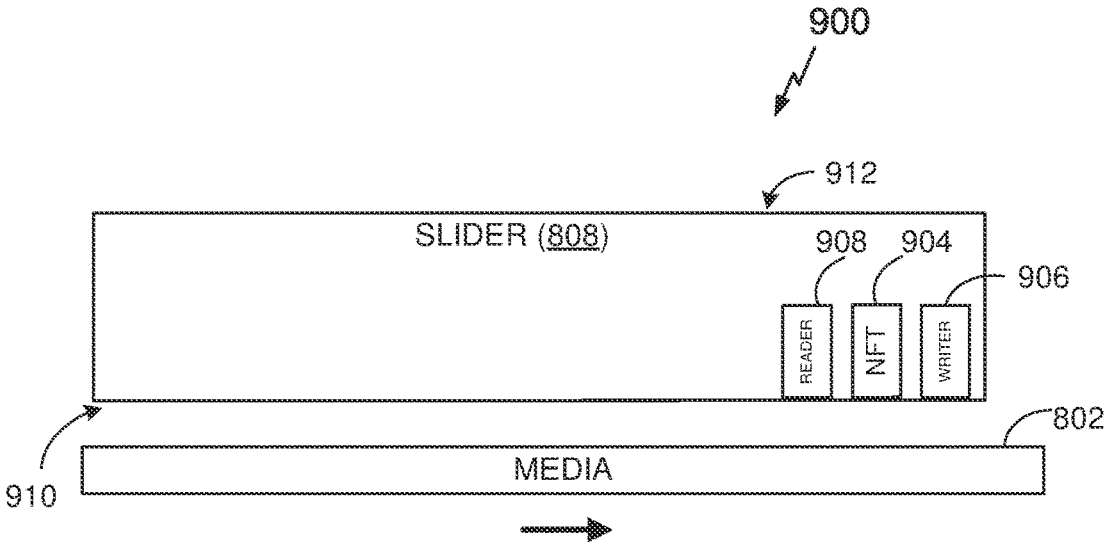
FIG. 9 illustrates a profile view of a slider and a disk in accordance with one aspect of the disclosure.

FIG. 9 illustrates a profile view of the slider 808 and the media 802 of FIG. 8. In particular, FIG. 9 illustrates an assembly 900 that includes the slider 808, a near-field transducer (NFT) 904 (if the head is a heat assisted magnetic recording (HAMR) head), a writer 906 and a reader 908. The NFT 904 may be omitted in a non-HAMR head, and other components may be used instead in other types of energy assisted recording technology (e.g., a spin torque oscillator (STO) in a microwave assisted magnetic recording (MAMR) head). The assembly 900 is positioned over the media 802. The slider 808 may be one component or several components. The slider 808 may include a slider and a slider head. In some implementations, a slider head may be a separate component that may be integrated with the slider 808. The NFT 904, the writer 906 and the reader 908 may be implemented in the slider, the slider head or combinations thereof. If the slider 808 is configured for HAMR, it may also include a laser, which may be mounted on the slider directly or using a sub-mount, which provides light energy to the NFT to heat a portion of the media 802 in conjunction with writing information. The slider 808 includes a first surface 910 (e.g., bottom surface) that faces the media 802. The first surface 910 may be referred to as an air bearing surface (ABS). The slider 808 also includes a second surface 912 (e.g., top surface) that faces away from the media 802. The NFT 904, the writer 906 and the reader 908 may be located near or along the first surface 910 of the slider 808. The writer 906 may be a writing element (e.g., means for writing data) for writing data on the media 802, and the reader 908 may be a reading element (e.g., means for reading data) for reading data on the media 802. The writer 906 may include a writing pole/writer pole.

The specification describes various embodiments for polishing a glass substrate using a grooved carrier. It shall be appreciated by those skilled in the art in view of the present disclosure that although various exemplary methods are discussed herein with reference to the polishing of glass substrates for magnetic recording disks, the methods, with or without some modifications, may be used for polishing glass substrates for other types of recording disks, for example, optical recording disks such as a compact disc (CD) and a digital-versatile-disk (DVD), or magneto-optical recording disks, or ferroelectric data storage devices. In addition, the methods, with or without some modifications, may be used for polishing or otherwise treating glass substrates for other applications. For example, the glass substrate may also be used in other applications, such as, for the touch screen of electronic devices such as lap-top computers, mobile phones and the like; for the cover plate glass of photoelectric (device) plates; or for the deposit substrate or the protective cover plate of film solar cells.

Various components described in this specification may be described as "including" or made of certain materials or compositions of materials. In one aspect, this can mean that the component consists of the particular material(s). In another aspect, this can mean that the component comprises the particular material(s).

The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another-even if they do not directly physically touch each other. It is further noted that the term "over" as used in the present application in the context of one component located over another component, may be used to mean a component that is on another component and/or in another component (e.g., on a surface of a component or embedded in a component). Thus, for example, a first component that is over the second component may mean that (1) the first component is over the second component, but not directly touching the second component. (2) the first component is on (e.g., on a surface of) the second component, and/or (3) the first component is in (e.g., embedded in) the second component. The term "about 'value X'", or "approximately value X", as used in the disclosure shall mean within 10 percent of the 'value X'. For example, a value of about 1 or approximately 1, would mean a value in a range of 0.9-1.1. In the disclosure various ranges in values may be specified, described and/or claimed. It is noted that any time a range is specified, described and/or claimed in the specification and/or claim, it is meant to include the endpoints (at least in one embodiment). In another embodiment, the range may not include the endpoints of the range. In the disclosure various values (e.g., value X) may be specified, described and/or claimed. In one embodiment, it should be understood that the value X may be exactly equal to X. In one embodiment, it should be understood that the value X may be "about X," with the meaning noted above.

As used herein, the term "determining" encompasses a wide variety of actions. For example, "determining" may include calculating, computing, processing, deriving, investigating, looking up (e.g., looking up in a table, a database, datastore, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

What is claimed is:

1. A carrier for retaining glass substrates during polishing, comprising:

a planar carrier body comprising a plurality of circular openings, each configured to receive a disk-shaped glass substrate;

wherein the carrier body comprises first grooves on a top surface of the carrier body;

wherein the carrier body comprises second grooves on a bottom surface of the carrier body;

wherein the carrier body is configured to be rotated relative to an adjacent polishing pad to polish a glass substrate; and wherein the first and second grooves are configured to:

facilitate a flow of a polishing slurry between the carrier body and the polishing pad during the polishing; and retain at least some of the polishing slurry near the glass substrates during the polishing.

2. The carrier of claim 1:

wherein the first grooves are offset from the second grooves along a plane that is substantially parallel to the planar carrier body.

3. The carrier of claim 1, further comprising a slurry passage hole configured to facilitate passage of the polishing slurry from one side of the carrier body to the other side of the carrier body.

4. The carrier of claim 3, wherein at least one of the first grooves intersects with the slurry passage hole.

5. The carrier of claim 3, wherein at least one of the first grooves intersects with at least one of the plurality of circular openings.

6. The carrier of claim 1, wherein the first grooves and the second grooves are substantially parallel to one another.

7. The carrier of claim 1, wherein the first grooves and the second grooves do not extend to an outer edge of the carrier.

8. The carrier of claim 1:

wherein the carrier body has a disk shape; and wherein the plurality of circular openings include eight openings.

9. A polishing machine comprising:

a central rotating mechanism configured to rotate the carrier of claim 1;

a first polishing pad in contact with the bottom surface of the carrier; and a second polishing pad in contact with the top surface of the carrier.

10. The polishing machine of claim 9:

wherein the central rotating mechanism comprises a drive gear comprising a plurality of teeth; and wherein a perimeter of the carrier comprises a plurality of teeth configured to engage the plurality of teeth on the drive gear.

11. A carrier for retaining glass substrates during polishing, comprising:

a planar carrier body comprising a plurality of circular openings, each configured to receive a disk-shaped glass substrate;

wherein the carrier body further comprises a slurry passage hole configured to facilitate passage of a polishing slurry from one side of the carrier body to the other side of the carrier body;

wherein the carrier body comprises first grooves on a surface of the carrier body;

wherein the carrier body is configured to be rotated relative to an adjacent polishing pad so that the glass substrates are polished; and wherein the first grooves are configured to facilitate a flow of the polishing slurry between the carrier body and the polishing pad during the polishing.

12. The carrier of claim 11:

wherein the carrier body comprises the first grooves on a top surface of the carrier body;

wherein the carrier body comprises second grooves on a bottom surface of the carrier body; and wherein the first grooves are offset from the second grooves along a plane that is substantially parallel to the planar carrier body.

13. The carrier of claim 11, wherein at least one of the first grooves intersects with the slurry passage hole.

14. The carrier of claim 11, wherein at least one of the first grooves intersects with at least one of the plurality of circular openings.

15. The carrier of claim 11, wherein the first grooves are substantially parallel to one another.

16. The carrier of claim 11, wherein the first grooves do not extend to an outer edge of the carrier.

17. The carrier of claim 11:

wherein the carrier body has a disk shape; and wherein the plurality of circular openings include eight openings.

18. A polishing machine comprising:

a rotating mechanism configured to rotate the carrier of claim 11;

a first polishing pad in contact with a bottom surface of the carrier; and a second polishing pad in contact with a top surface of the carrier.

19. The polishing machine of claim 18:

wherein the rotating mechanism comprises a drive gear comprising a plurality of teeth; and wherein a perimeter of the carrier comprises a plurality of teeth configured to engage the plurality of teeth on the drive gear.

20. A method for polishing glass substrates using a carrier for retaining the glass substrates during polishing, the method comprising:

providing the carrier comprising:

a planar carrier body comprising a plurality of circular openings, each configured to receive a disk-shaped glass substrate;

wherein the carrier body comprises first grooves on a top surface of the carrier body;

wherein the carrier body comprises second grooves on a bottom surface of the carrier body;

placing the carrier on a first polishing pad of a polishing machine;

placing glass substrates within the circular openings of the carrier;

placing a second polishing pad on the carrier;

providing a polishing slurry on the carrier, wherein the first and second grooves facilitate a spreading of the polishing slurry; and rotating the carrier between the first and second polishing pads to polish the glass substrates, wherein the first and second grooves are configured to facilitate a spreading of the polishing slurry and to retain at least some of the polishing slurry near the glass substrates during the polishing.

* * * * *